US006195842B1

(12) United States Patent
Freund et al.

(10) Patent No.: US 6,195,842 B1
(45) **Date of Patent: *Mar. 6, 2001**

(54) FEEDING CARDED FIBER TO AN AIRLAY

(75) Inventors: Kenneth Stephen Freund, Gallatin; Andrew James Giles, Joelton; Todd Arden McCoy, Hendersonville; Lyles Howard Sowell, Old Hickory; Phillip Osborne Staples, Nashville; Leonard Ray Tucker, Hendersonville, all of TN (US); James Stephen Bailey, Arlington, VA (US)

(73) Assignee: E. I. du Pont de Nemours and Company, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/760,119

(22) Filed: Dec. 3, 1996

Related U.S. Application Data

(60) Provisional application No. 60/008,370, filed on Dec. 8, 1995.

(51) Int. Cl.[7] ..... D01G 15/46; D01G 25/00
(52) U.S. Cl. ..... 19/106 R; 19/296
(58) Field of Search ..... 19/98, 65 R, 106 R, 19/106 A, 65 A, 296, 304, 305

(56) References Cited

U.S. PATENT DOCUMENTS

| | | | | |
|---|---|---|---|---|
| 3,641,628 | * | 2/1972 | Fehrer | 19/156.4 |
| 3,797,074 | * | 3/1974 | Zafiroglu | 19/156.3 |
| 3,906,588 | * | 9/1975 | Zafirolgu | 19/156.3 |
| 3,932,915 | * | 1/1976 | Contractor et al. | 19/156.3 |
| 4,097,965 | * | 7/1978 | Gotchel et al. | 19/306 |
| 4,123,211 | * | 10/1978 | Rudloff | 19/296 |
| 4,130,915 | * | 12/1978 | Gotchel et al. | 19/304 |
| 4,475,271 | * | 10/1984 | Lovgren et al. | 19/105 |
| 4,489,462 | * | 12/1984 | Dodson, Jr. | 19/296 X |
| 4,534,086 | * | 8/1985 | Fehrer | 19/302 X |
| 5,007,137 | * | 4/1991 | Graute | 19/296 |
| 5,537,718 | * | 7/1996 | Nagatsuka et al. | 19/296 X |
| 5,584,101 | * | 12/1996 | Brabant et al. | 19/106 R X |

FOREIGN PATENT DOCUMENTS

| | | | | |
|---|---|---|---|---|
| 44 30 500 | * | 2/1996 | (DE) | D01G/25/00 |
| 0 378 807 | * | 7/1990 | (EP) | D04H/1/72 |
| 2 279 083 | * | 12/1994 | (GB) | D01G/25/00 |
| 6-116853 | * | 4/1994 | (JP) | D04H/1/72 |

* cited by examiner

*Primary Examiner*—John J. Calvert
*Assistant Examiner*—Larry D. Worrell, Jr.

(57) ABSTRACT

A process of feeding carded fiber to an airlay and particularly to combining carding technology with airlay technology. A carding machine portion is arranged to card fiber while a disperser-roll in the airlay portion picks the individualized carded fibers from a tool bed roll and centrifugally doffs them into an air stream. As such, airlays will be able to handle longer fiber lengths which conventional airlay equipment is unable to handle or satisfactorily open up. Further, an improved process for doffing fiber from a airlay machine and particularly centrifugally doffing fiber from a carding machine.

28 Claims, 3 Drawing Sheets

FEEDING CARDED FIBER TO AN AIRLAY

This application claims the benefit of U.S. Provisional Application Ser. No. 60/008,370, filed Dec. 8, 1995.

FIELD OF THE INVENTION

This invention relates to airlay fiber handling equipment such as an airlay web former and more particularly to doffing individualized carded fibers into an air stream.

BACKGROUND OF THE INVENTION

Airlays are used for opening fiber and putting the fiber into an air stream. A conventional airlay is disclosed in U.S. Pat. No. 3,797,074 to Zafiroglu issued on Mar. 19, 1974. However, one of the drawbacks or limitations of Zafiroglu is that it has difficulty opening medium and long staple fibers.

By comparison, carding machines are quite good at separating fibers into their individual filaments. However, the individualized fibers on carding machines are typically doffed at slow speeds into a carded web or sliver. To the extent that there are known techniques and arrangements for doffing the fiber from a carding machine into an air stream, such techniques are generally quite unsatisfactory. There are numbers of references, such as U.S. Pat. No. 3,641,628 to Fehrer, U.S. Pat. No. 4,097,965 to Gotchel et al., U.S. Pat. No. 4,130,915 to Gotchel et al., and U.S. Pat. No. 4,475,271 to Lovgren et al. which show air doffing cards. Typical of such arrangements is an air knife or air jets arranged to blow fiber from the doffing roll or main carding roll. With such arrangements, the fiber is carried away by a very turbulent air flow. Such highly turbulent air carries away the fibers in clumps and not individualized.

It has long been understood that carding offers certain advantages and airlays offers others. While it may appear logical to the unskilled person to simply feed a carded web to an airlay, there are significant technical and economic reasons that lead away from such an arrangement.

Carding machines and airlaying equipment are each quite expensive capital items and are generally considered by those skilled in the art to be mutually exclusive and separate technologies. Thus, one selects to use one technology or the other. The potential added value to the customer (the highest price the customer would be willing to pay for such products) would simply not justify the substantial added processing and equipment costs.

In addition to the economic drawbacks of feeding a carded web to an airlay, there are significant technical problems to overcome. Airlays are notorious for pulling clumps of fiber and dispersing the whole clump into the air stream. While the Zafiroglu technique has been used quite satisfactorily, it took significant subsequent development including the development by Contractor et al. in U.S. Pat. No. 3,932,915 on Jan. 20, 1976 to really get the system working satisfactorily. But even now, the fibers that are fed to the airlay are shorter than average staple length fiber.

Longer fibers are much more difficult to control coming through feed rollers or other feed mechanisms to be picked by the disperser roll. Most of the fiber opening done by an airlay is done by the interaction of the disperser roll and the feed rolls. Once the fiber is on the disperser roll, unless it is a chip of fibers, it is dispersed into the air stream in the same basic form in which it is carried to the duct. Pulling or picking a long fiber (as compared to a shorter fiber) from between the feed rolls more typically causes other long fibers to be pulled through the feed rolls with it. With each such long fiber, the disperser picks a clump of fibers. However, if the feed rolls are arranged to press tighter together to control clumping, the fibers may be stretched and broken or the fibers may drag hard through the feed rolls causing the build up of frictional heat. Either result will be deleterious to the commercial operation of the airlay. The problems are particularly exacerbated by the nature of carding machines which tend to provide linearly oriented fibers. As such, the fibers enter the feed rolls in the worst possible orientation for the disperser roll to pick them from the feed rolls. The arrangement for feeding carded fiber to an airlay would be one of the first problems to be overcome to achieve successful operation.

In spite of the apparent difficulties, it is an object of the present invention to provide a system and process for centrifugally dispersing individualized carded fiber which overcomes the above noted drawbacks of the prior art.

It is a more particular object of the present invention to provide a system and process for taking fiber from a carding machine and feeding it to an airlay which overcomes or avoids the problems described above.

SUMMARY OF THE INVENTION

The above and other objects of the invention are accomplished by a process for feeding carded fiber from a carding machine to an airlay wherein the process includes carding fiber with at least one carding roll having a toothed peripheral surface and combing elements engaging fiber on the carding roll into individualized carded fibers. The individualized carded fibers are then transferred from the surface of the carding roll to a rotating disperser roll. The rotating disperser roll then centrifugally doffs the individualized carded fibers therefrom.

The invention may also be summarized as comprising a process for centrifugally doffing fibers from a carding machine wherein fibers are carded by the interaction of toothed carding equipment to individualize and comb the fiber into individualized fibers and the fibers are transferred to a rotating disperser roll. The disperser roll has a toothed peripheral surface and centrifugally doffs the individualized fibers from the disperser roll by being rotated at a rotational speed sufficient to tangentially throw off a substantial portion of individualized fibers.

In addition, the invention generally comprises a system for carding fiber into individualized fibers and centrifugally doffing the individualized carded fibers. The system includes a main carding roll and equipment to comb and individualize the fibers on the main carding roll and a disperser roll having a toothed peripheral surface arranged to receive individualized fibers from the main carding roll. The disperser roll centrifugally doffs fibers from the teeth thereof by rotating at a speed sufficient to tangentially throw fibers therefrom.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily to scale. The drawings are briefly described as follows.

DETAILED DESCRIPTION OF THE PREFERRED EMBODIMENT

Figure 1:
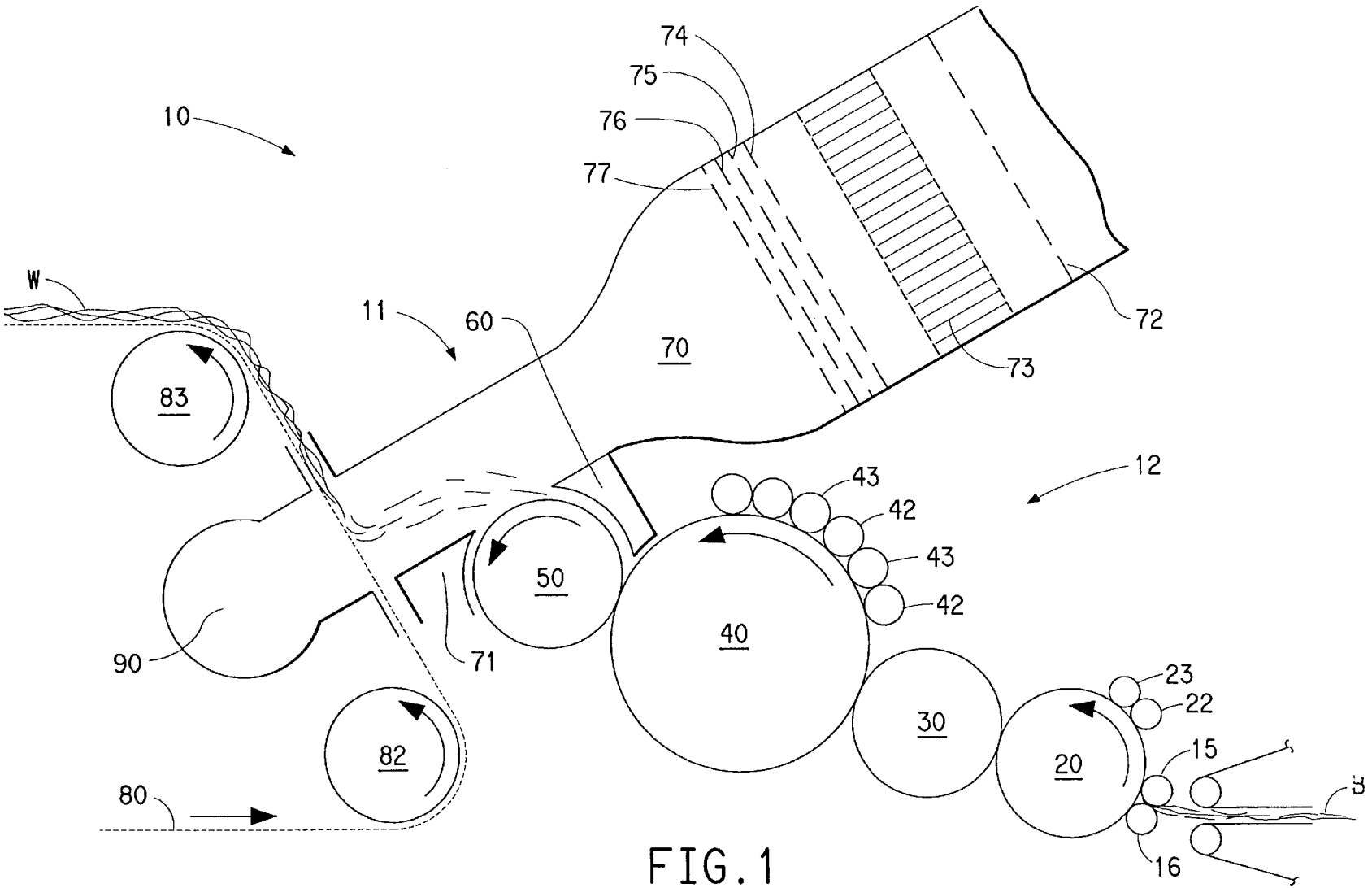
FIG. 1 is a generally schematic elevational view of centrifugally doffed carding machine showing the features of the invention.

Referring now to the drawings, the invention will be described in greater detail so as to explain the contribution to the art and its application in the industry. Referring specifically to FIG. 1, the fiber handling system of the present invention is generally referred to by the number 10 and may be more easily understood as having an airlay portion generally indicated by the reference number 11 and a carding machine portion generally indicated by the reference number 12. As the present invention handles the process through the carding machine portion 12 first and then through the airlay portion 11, the description will begin with the carding machine portion 12 first and then move to the airlay portion 11 so as to follow the path of the fiber through the system 10 of the present invention.

The carding machine portion 12 is arranged to receive fiber in the form of a batt B that is comprised of tufts of fiber to be separated into individualized fibers. The fiber is provided into the system 10 by a suitable feed mechanism such as an opposed pair of feed rollers 15 and 16. The feed rollers 15 and 16 receive the batt B of fiber from a suitable source by a conveyor and pinch the batt therebetween as the batt B is fed to the lickerin roll 20. It should be understood that there are numerous potential arrangements for providing fiber on a lickerin roll and that the invention is not limited to any particular illustrated or described fiber delivery technique.

The lickerin roll 20, as is conventional in the art, comprises a wire or card clothing on its peripheral surface or other suitable toothed surface for picking the fiber from the batt at the feed rolls 15 and 16. The batt B is effectively dismembered by the teeth on the lickerin roll 20. The lickerin roll 20 may be provided with one or more workers 22 and associated strippers 23 to pick tufts of fiber from the teeth of the lickerin roll 20 and comb and draft the tufts out to separate the fibers. The lickerin roll 20 passes or transfers the fiber to a communicator roll 30 which may further draft fiber and provide more workers and strippers (not shown) for the carding machine portion 12 of the system 10.

The communicator roll 30 passes or transfers the fiber onto the main carding roll 40. The roll communicator roll 30 may be arranged to rotate in either direction but would most likely be rotated in the clockwise direction to move with the lickerin roll 20 and the main carding roll 40. Arranged along the top surface of the main carding roll 40 are associated worker and stripper rolls 42 and 43, respectively. In the illustrated configuration, the worker and stripper rollers 42 and 43 are in a garnet configuration such that every other roller is a worker roller 42 with a stripper roller 43 positioned therein between. As is well known in the carded fiber art, the worker and stripper rolls may also be arranged in a conventional arrangement where spaced pairs of stripper and worker rolls are arranged to comb and separate the fibers. It is also similarly known to comb the fiber with combing elements that are not rolls at all, but may be fixed plates, called flats or rotating belts having teeth arranged to comb fiber on the carding roll. The particular arrangement, whether garnet or conventional or other type of arrangement, is really not pertinent to the invention except for the fact that the fiber is carried by a toothed device and is worked by combing elements to separate and individualize the fibers without overworking it into unusable neps or other fiber defects.

On the opposite side of the main carding roll 40 from the lickerin roll 20 and communicator roll 30 is a disperser roll 50 which is part of the airlay portion 11 of the system 10. The disperser roll 50 doffs the fiber from the main carding roll 40, but operates considerably different than conventional doffing rolls for carding machines. The disperser roll 50 of the present invention preferably rotates opposite or against the direction of rotation of the main carding roll 40. In addition, the disperser roll 50 rotates at a relatively high speed to create substantial centrifugal forces to tangentially throw off or centrifugally doff the fiber from the disperser roll 50. A conventional doffing roll for a carding machine would typically move in the same direction as the main carding roll, but much slower than the main carding roll. As compared to the present invention, all the rolls in a conventional carding machine are operated so as not to allow the fiber to centrifugally separate from the teeth. A carding machine would be "out of control" by conventional standards if fiber were "flying off" any roll.

The disperser roll 50 picks a substantial portion of the fiber carried by the main carding roll 40 therefrom which, as compared to conventional carding arrangements, is contrary to the operation of a standard doffing roll. In a conventional arrangement, a significant portion of the fiber on the main carding roll 40 would be recycled around the bottom portion of its path of rotation to again be subjected to the worker and stripper rolls 42 and 43. Since the main carding roll 40 has limited capacity, the fiber feed at feed rolls 15 and 16 would have to be controlled so that no more fiber is put into the system than is coming out. The disperser roll 50 increases the productivity and throughput of the carding machine portion 12 of the system 10 by doffing fiber at a higher rate than conventional doffing systems.

The disperser roll 50 picks a high percentage of fiber to transfer from the main carding roll 40 because of its higher surface speed. More teeth on the disperser roll 50 have an opportunity to pick each fiber on the main carding roll 40 when the disperser roll 50 is run faster than the main carding roll 40. A second reason the disperser roll 50 picks up a high percentage of the fiber from the main carding roll 40 is that the disperser roll 50 is preferably arranged to rotate opposite the direction of rotation of the main carding roll 40. It should be understood that the teeth on a roll are oriented so as to pick or receive fiber while rotating in a particular direction of rotation. While the invention will still be fully operable with the disperser roll 50 running in the same rotational direction as the main carding roll 40, it transfers a higher percentage of the fiber from the main carding roll 40 to the disperser roll 50 when rotating opposite the main carding roll 40. The reason more fiber is transferred is that the teeth on the disperser roll 50 have more opportunities to pick up the fibers from the main carding roll 40. When one tooth on the disperser roll 50 contacts a fiber but does not pick it up, the fiber is swept back so that the next succeeding tooth may have a chance to pick it off. If the main carding roll 40 rotates in the same direction as the disperser roll 50, then when a tooth on the disperser roll 50 contacts a fiber but does not pick it off the main carding roll 40, it is likely that the fiber may well be swept out of reach of the next succeeding tooth on the disperser roll 50. Thus, it is preferred that the disperser roll 50 rotates at substantial surface speed opposite the direction of rotation of the main carding roll 40.

It should also be noted that the problems noted above about feeding fiber onto the disperser roll 50 of the airlay portion 11 are avoided by transferring the fibers directly from the main carding roll 40 onto the disperser roll 50. There are no feed rolls or equipment to pinch a batt of carded fiber being fed to the disperser roll 50 that would lead to the problem of pulling clumps onto the disperser roll 50.

As previously noted, the disperser roll 50 rotates at a fairly high speed. The disperser roll 50 must be rotated at a speed which, in accordance with its design, will generate sufficient centrifugal force that the fibers will overcome the frictional and other resistive forces to be thrown from the teeth of the disperser roll 50. The design considerations of the disperser roll 50 include, among other issues, the length, angle and smoothness of the teeth and the diameter of the roll. Teeth projecting from the surface in an orientation close to radially outwardly from the roll will require less rotational speed and centrifugal force to doff fiber than teeth angled more toward a tangential orientation. A smaller diameter roll will generate greater centrifugal forces than a larger roll when the surface speeds are the same. In the preferred arrangement, the roll is approximately twenty inches in diameter and has teeth arranged between one and sixteen degrees from the radius and rotates such that the surface speed is between about 1500 meters per minute up to about 4000 meters per minute. Clearly, there are suitable designs that would be outside one or even all of these parameters, but would still be within the spirit of the invention.

In the preferred arrangement, the disperser roll 50 has three zones at different radial portions of its periphery. The first zone is a fiber receiving zone. The fiber receiving zone is where the fiber is picked up by the disperser roll 50 and, in the embodiment illustrated in FIG. 1 is at the interface with the main carding roll 40. The second zone immediately follows the fiber loading zone and may be referred to as the fiber handling zone. The third and next zone is the centrifugal doffing zone where the fibers are intended to be doffed from the disperser roll 50.

Figure 2:
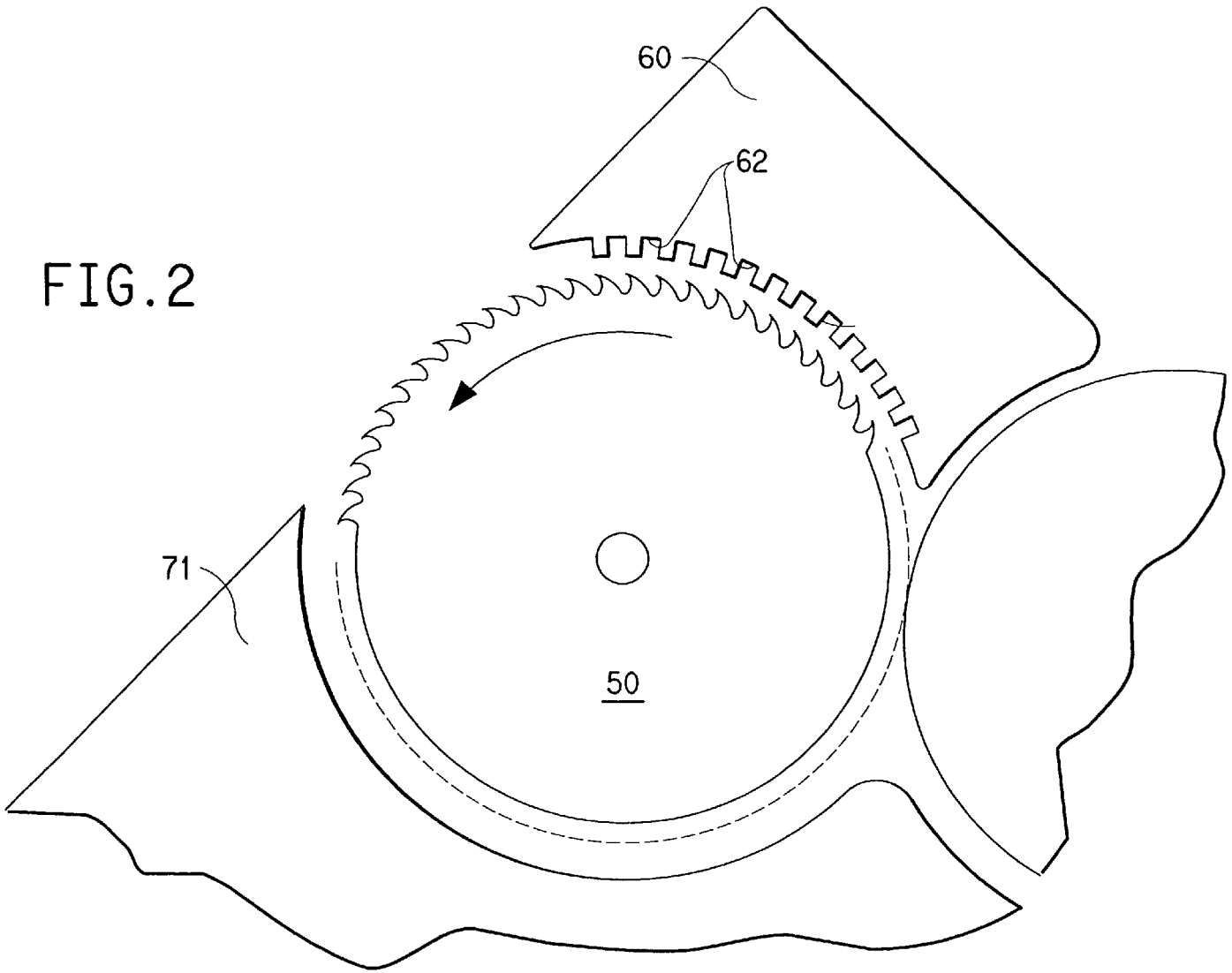
FIG. 2 is an enlarged fragmentary view of the doffing roll and disperser shroud in FIG. 1.

The fiber handling zone is characterized by a shroud 60 overlying the surface of the disperser roll 50. The shroud 60 has a particular design that is best illustrated in FIG. 2 and has a design similar to the disperser plate disclosed in U.S. Pat. No. 3,932,915 on Jan. 20, 1976, to Contractor et al. The shroud 60 is particularly designed to impose drag on the air around the disperser roll 50, which may also be characterized as aerodynamic drag. In particular, the shroud 60 is provided with a series of grooves 62 which form a rough surface which aerodynamically prevents the boundary layer of air around the disperser roll 50 from building very thick. While air is allowed to be carried between and around the teeth of the disperser roll 50, the air just beyond the tips of the teeth is not permitted to be carried along therewith at the same surface speed. As such, the slower moving air in close proximity to the teeth causes drag on the fibers carried on the teeth so as to keep them down close to the surface of the disperser roll 50. When the fibers come out from under the shroud 60, the boundary layer quickly builds which allows the fibers to separate from the teeth of the disperser roll 50 by the pull of the centrifugal forces. Clearly, there may be other suitable designs for shrouds that will create resistance to the movement of boundary layer air along the disperser roll 50 such as different surface configurations, or air jets, baffles and other suitable devices. The shroud 60 illustrated in FIG. 2 is simply a preferred arrangement for the present invention.

Referring again to FIG. 1, the disperser roll 50 carries the fiber from the main carding roll 40, under shroud 60 and to an air duct 70. In the air duct 70, an air stream is arranged to pass over the surface of the disperser roll 50 in a generally tangential relationship to receive the fiber being doffed from the disperser roll 50. The fiber is quite likely to doff from the disperser roll 50 without the presence of the air stream creating a cloud of individualized fiber; however, it is preferred to provide the individualized fiber into an air stream where it may be more easily handled. In the present invention, it is preferred that the air stream be generally free of turbulence so as to allow the fiber to be evenly dispersed throughout the air stream. Eddies, vortices and other turbulence tend to disturb the distribution of the fiber in the air duct 70 which causes undesirable consequences depending on the use that will be made with the fiber in the air stream. In the case where a web is produced, as shown in the drawing figures, such webs have splotchiness and non-uniformity's cause by the fiber following the vortices and eddies and not laying down evenly.

Thus, as shown in the drawing figures, an air stream is created in the air duct 70 by a suitable fan (not shown) or other source such that the air stream moves in the same direction as the surface of the disperser roll 50. The air stream is relative straight and laminar after having been directed through a pre-filter 72, a honeycomb-type air straightener 73 and secondary filters 74, 75, 76, and 77. The air stream accelerates as it passes into an area of reduced cross section shortly before it passes over the surface of the disperser roll 50. It is important that the speed of the air stream be less than or equal to the speed of the disperser roll 50 at its surface. Otherwise, the airstream will tend to blow the fiber off the disperser roll 50 which will undermine the intended effect of centrifugally doffing the fiber. If the fiber were to be blown off the roll, it would tend to come off in clumps and create more turbulence, and larger eddies and vortices. Preferably, the speed of the air stream is less than or equal to about 95 percent of the surface speed of the disperser roll 50 as the air stream passes over the disperser roll 50. With the straightened air stream passing over the surface of the disperser roll 50, the fiber tends to transition more gently from one mode of conveyance (the teeth on an roll) to a second mode (the straightened air stream).

An additional element for satisfactorily centrifugally doffing fiber from the disperser roll 50 is a doffing bar 71. The doffing bar 71 functions similarly to a doctor blade for separating at least a portion of the boundary layer of air around the surface of the disperser roll 50 thereby preventing the fiber from re-entraining with the boundary layer and following the disperser roll 50 back to the main carding roll 40. In particular, the performance of the doffing bar has been improved by providing a much sharper leading edge as compared to the conventional blunt doffing bars. The sharper doffing bar tends to shear the boundary layer of air where the conventional blunt doffing bar tends to have a buildup of air pressure which causes the boundary layer to divide itself. Also, it apparently collects fewer stray fibers if the air duct side of the doffing bar is co-planar with the remainder of the air duct extending toward the screen consolidation belt 80 and is generally aligned with a plane that is tangential to the surface of the disperser roll 50 at the base of the teeth thereof.

The fiber can be laid into a web on a screen conveyor belt 80 at the base of the air duct 70. The screen conveyor belt 80 is carried by a series of rollers including roller 82 and 83. Below the screen conveyor 80 is a vacuum duct 90 arranged to pull air in the air duct 70 down through the screen conveyor belt 80 to pin the fiber thereon and remove it from the system. The air may be discharged from the system 10 or recirculated to be directed again through the air duct 70 as desired.

Figure 3:
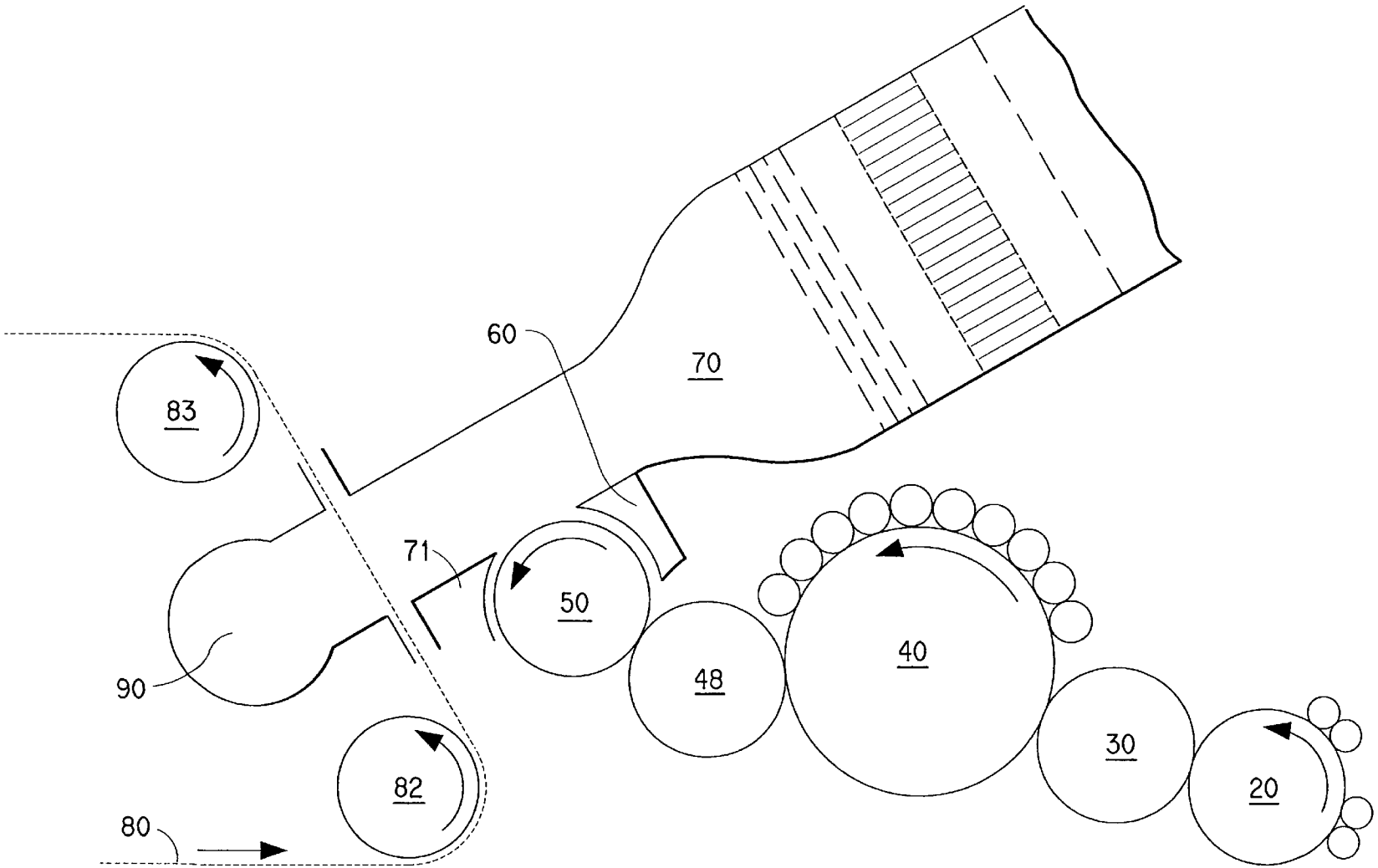
FIG. 3 is a view similar to FIG. 1 showing a second embodiment of the invention.

Turning now to the second embodiment illustrated in FIG. 3, the equipment is essentially the same and the same reference numerals are used to indicate the same equipment or features. However, in this second embodiment, there is a communicator roll 48 between the main carding roll 40 and the disperser roll 50 for transferring fiber from one roll to another. The communicator roll 48 may be arranged to rotate in either direction but would most likely be rotated clockwise to move with the main carding roll 40 and the disperser roll 50. The reasons for providing one or more communicator rolls 48 are varied. The essential feature of the communicator roll 48 is that it has teeth on the periphery and carries fiber, preferably individualized carded fibers on the teeth from which the disperser roll 50 may pick it off or have it transferred thereto. This second embodiment particularly illustrates the possibility that the disperser roll 50 does not necessarily need to interact directly with the main carding roll 40 to doff individualized carded fiber pursuant to the present invention. For purposes of this invention, the term "main carding roll" is used to mean the only roll or the last roll in an arrangement of several rolls having teeth such as card clothing and which include associated rollers or fixed teeth or the like to draft and comb fibers for the purpose of separating fiber into individual filaments. Thus, roll 48 is not a "main carding roll" as described above. Conversely, the main carding roll 40 is not the only carding roll in the system 10 as the lickerin roll 20 includes worker and stripper rolls 22 and 23.

Whether the disperser roll 50 picks fiber directly from the main carding roll 40 or from a communicator type roll 48 is really of little significance to the invention. However, it should be understood that the invention is directed to taking fiber which has been carded and individualized by equipment selected from conventional carding technology and almost immediately providing the fiber to the disperser roll 50 without consolidation or doffing to form a sliver, batt, web or other fibrous structure. The disperser roll 50 then centrifugally doffs the fiber as has been described.

The foregoing description and drawings were presented to explain the invention and its operation and should not, in any way, limit the scope of coverage that may be afforded by any patent granted from this application. Clearly, the scope of the exclusivity is defined and should be measured and determined by the claims that follow.

We claim:

1. A process for feeding carded fiber from a carding machine to an airlay comprising the steps of:

carding fiber on at least a main carding roll having a toothed peripheral surface with combing elements engaging fiber on the main carding roll into individualized carded fibers;

transferring the individualized fibers directly from the main carding roll to a rotating disperser roll; and centrifugally doffing the individualized carded fibers from the disperser roll.

2. The process according to claim 1 wherein the step of transferring individualized fibers further comprises rotating the disperser roll opposite the direction of rotation of the carding roll.

3. The process according to claim 1 wherein the step of transferring individualized fibers comprises transferring fibers from the carding roll to a communicator roll and then transferring the individualized carded fibers to the disperser roll.

4. The process according to claim 3 wherein the step of transferring individualized fibers further comprises rotating the disperser roll opposite the direction of rotation of the communicator roll.

5. The process according to claim 1 wherein the step of centrifugally doffing fibers further comprises directing an air stream over the surface of the disperser roll at a speed not greater than the surface speed of the disperser roll and centrifugally doffing the individualized carded fibers into the air stream.

6. The process according to claim 5 wherein the step of directing an air stream comprises directing an air stream at a speed of not greater than ninety-five percent of the speed of the disperser roll at its surface.

7. The process according to claim 1 further including the step of imposing drag on a boundary layer of air over the disperser roll to substantially prevent the individualized fibers from centrifugally separating from the disperser roll prematurely.

8. The process according to claim 1 further comprising the step of separating at least a portion of a boundary layer of air moving along with the surface of the disperser roll to substantially prevent the fiber from following the surface of the disperser roll and re-entraining into the boundary layer of air.

9. The process according to claim 8 wherein said step of centrifugally doffing fibers further comprises directing an air stream through an air duct and over the surface of the disperser roll at a speed not greater than the surface speed of the disperser roll and centrifugally doffing the individualized carded fibers into the air stream and wherein said step of separating at least a portion of the boundary layer further comprises shearing the boundary layer with a relatively sharp leading edge of a doffing bar which is arranged to have a flat surface forming one side of the air duct, and wherein the flat surface is arranged in a plane which is generally tangential with the peripheral surface of the disperser roll at the base of teeth thereon.

10. A process for centrifugally doffing fiber from a carding machine, wherein the process comprises the steps of:

carding fiber with interacting, toothed carding equipment to individualize and comb the fiber into individualized fibers wherein the carding equipment comprises at least a main carding roll;

rotating a disperser roll, having a toothed peripheral surface, at a rotational speed sufficient to tangentially throw off a substantial portion of individualized fibers which are carried on the teeth thereof;

transferring substantially individualized fibers from the main carding roll directly to the dispersing roll; and centrifugally doffing individualized carded fibers from the disperser roll.

11. The process according to claim 10 wherein the step of transferring individualized fibers further comprises rotating the disperser roll opposite the direction of rotation of the carding roll.

12. The process according to claim 10 wherein the step of transferring fibers from the carding equipment comprises transferring fibers directly from the carding equipment to at least one communicator roll and then transferring the individualized carded fibers to the disperser roll.

13. The process according to claim 12 wherein the step of transferring individualized fibers further comprises rotating the disperser roll opposite the direction of rotation of the communicator roll.

14. The process according to claim 10 wherein the step of centrifugally doffing fibers further comprises directing an air stream over the surface of the disperser roll at a speed not greater than the surface speed of the disperser roll and centrifugally doffing the individualized carded fibers into the air stream.

15. The process according to claim 14 wherein the step of directing an air stream comprises directing an air stream at a speed of not greater than ninety-five percent of the speed of the disperser roll at its surface.

16. The process according to claim 10 further comprising the step of separating at least a portion of a boundary layer of air moving generally along with the surface of the disperser roll to substantially prevent the fiber from following the surface of the disperser roll and re-entraining into the boundary layer of air.

17. The process according to claim 16 wherein said step of centrifugally doffing fibers further comprises directing an air stream through an air duct and over the surface of the disperser roll at a speed not greater than the surface speed of the disperser roll and centrifugally doffing the individualized carded fibers into the air stream and wherein said step of separating at least a portion of the boundary layer further comprises shearing the boundary layer with a relatively sharp leading edge of a doffing bar which is arranged to have a flat surface forming one side of the air duct, and wherein the flat surface is arranged in a plane which is generally tangential with the peripheral surface of the disperser roll at the base of teeth thereon.

18. The process according to claim 10 further including the step of imposing drag on a boundary layer of air over a portion of the surface of the disperser roll to substantially prevent the fibers from prematurely centrifugally separating from the disperser roll.

19. A system for carding fiber into individualized carded fibers comprising:

a main carding roll having combing and drafting equipment associated therewith to draft and individualize fibers on said main carding roll; and a disperser roll having a toothed peripheral surface and which rotates at a speed sufficient to centrifugally doff a majority of the fibers from the teeth thereof at a centrifugal doffing zone and which is arranged to directly receive individualized carded fibers from the main carding roll.

20. The system according to claim 19 wherein said disperser roll includes teeth oriented to pick fibers from the main carding roll by rotating opposite the direction of rotation of said main carding roll.

21. The system according to claim 19 further including a communicator roll which is arranged to receive the individualized fibers from the carding roll and transfer the individualized fibers to said disperser roll.

22. The system according to claim 21 wherein said disperser roll includes teeth oriented to pick fibers from said communicator roll by rotating opposite the direction of rotation of said communicator roll.

23. The system according to claim 19 further including an air duct arranged to direct an air stream over the surface of the disperser roll.

24. The system according to claim 23 wherein said air duct is arranged to overlie the disperser roll and carry the air stream and fiber from said disperser roll.

25. The system according to claim 21 further comprising a doffing bar for separating a boundary layer of air from adjacent the surface of the disperser roll and to substantially prevent the fiber from following the surface of the disperser roll and re-entraining into the boundary layer of air.

26. The system according to claim 25 further including an air duct arranged to direct an air stream over the surface of the disperser roll, and wherein said doffing bar has a relatively sharp leading edge to shear the boundary layer of air and includes a relatively flat surface defining a portion of said air duct wherein said flat surface is generally arranged along a plane which is tangential to the surface of said disperser roll at the base of the teeth thereof.

27. The system according to claim 21 further including a shroud for imposing drag on the fibers attached to the teeth of the disperser roll to cause the fibers on the teeth of the disperser roll to remain pinned to the teeth prior to said centrifugal doffing zone.

28. The system according to claim 27 wherein said shroud further comprises a grooved surface opposed to said disperser roll such that the grooves provide aerodynamic resistance to the boundary layer of air over the disperser roll.

* * * * *